United States Patent [19]

Armbruster

[11] 4,037,079

[45] July 19, 1977

[54] BATHROOM MIRROR DEFOGGER

[76] Inventor: Joseph M. Armbruster, 3701 N. 29th Ave., Hollywood, Fla. 33020

[21] Appl. No.: 602,306

[22] Filed: Aug. 6, 1975

[51] Int. Cl.[2] ..... H05B 1/00; E06B 7/12; F24H 3/04

[52] U.S. Cl. ..... 219/219; 52/171; 98/90; 219/203; 219/366; 219/370; 350/63; 415/54

[58] Field of Search ..... 219/203, 219, 369, 370, 219/364, 366; 52/171; 415/54; 98/2.08, 2.09, 90–92, 2.01, 36; 350/61–63

[56] References Cited

U.S. PATENT DOCUMENTS

| | | | |
|---|---|---|---|
| 1,743,638 | 1/1930 | Tefft | 219/203 X |
| 1,933,220 | 10/1933 | Petree | 219/364 |
| 2,005,581 | 6/1935 | Gary et al. | 219/203 UX |
| 2,064,498 | 12/1936 | Shackford et al. | 219/203 X |
| 2,617,701 | 11/1952 | Fennell | 52/171 X |
| 2,796,506 | 6/1957 | Lumbert | 219/219 |
| 3,177,794 | 4/1965 | Laing | 219/370 UX |
| 3,200,705 | 8/1965 | Voelker et al. | 219/219 X |
| 3,280,901 | 10/1966 | Laing | 219/370 UX |
| 3,362,469 | 1/1968 | Berner et al. | 415/54 UX |

*Primary Examiner*—A. Bartis

*Attorney, Agent, or Firm*—Clarence A. O'Brien; Harvey B. Jacobson

[57] ABSTRACT

A generally horizontal and cylindrical hollow housing is provided for mounting slightly outward of the upper marginal edge portion of a bathroom mirror and the housing includes an elongated entrance slot formed in one side thereof for opening toward the adjacent mirror as well as a second longitudinal outlet slot circumferentially spaced from the inlet slot in a manner to open inwardly toward and downwardly along the associated bathroom mirror. A motor driven blower wheel or drum is rotatably journaled in the housing in a manner so as to draw ambient air into the housing through the inlet slot and exhaust air outwardly from the housing through the outlet slot downwardly along the space of the associated mirror for the purpose of maintaining the latter free of condensation thereon, even when the conditions for the formation of condensation on the mirror are excessive.

2 Claims, 3 Drawing Figures

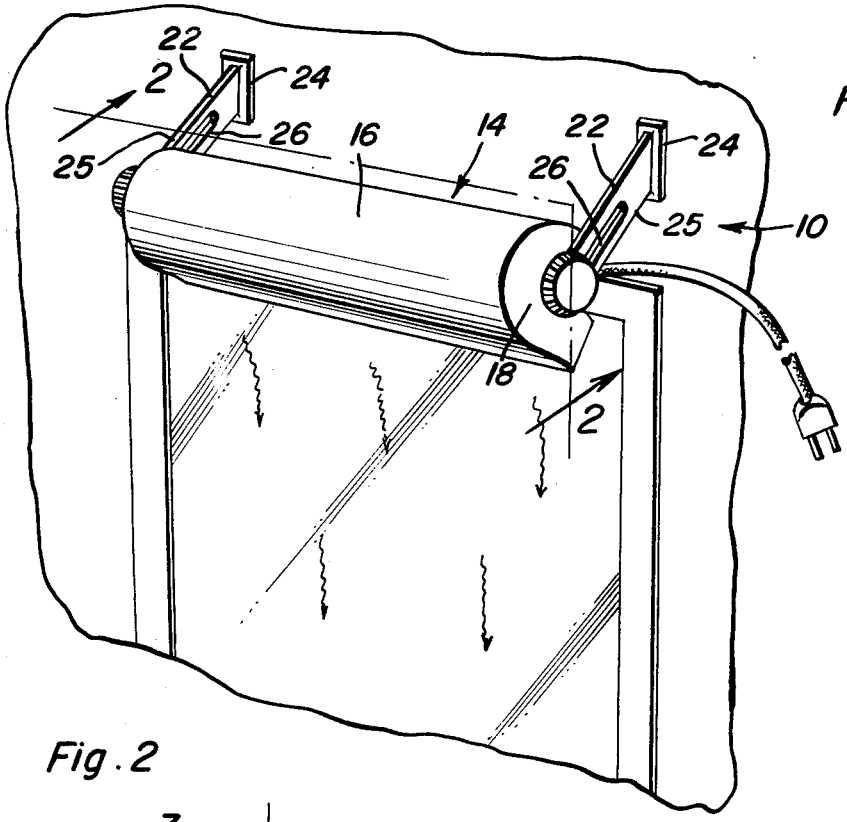
Fig. 1
Fig. 2
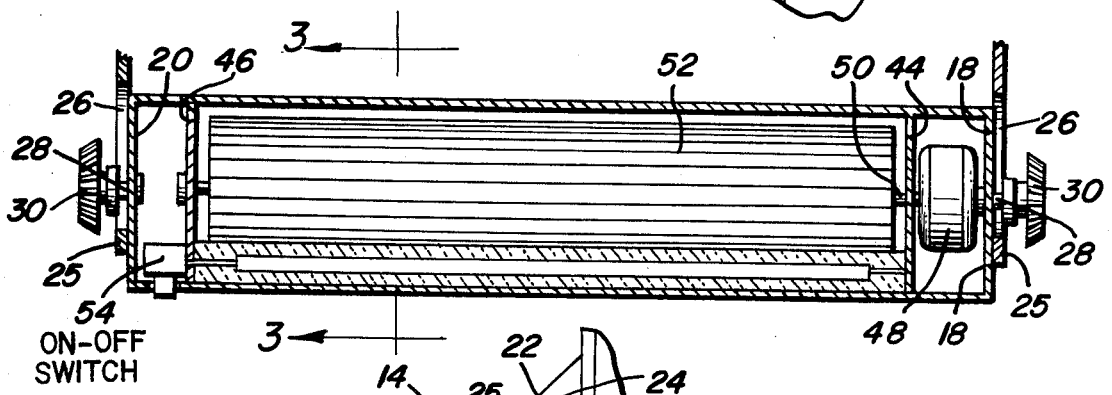
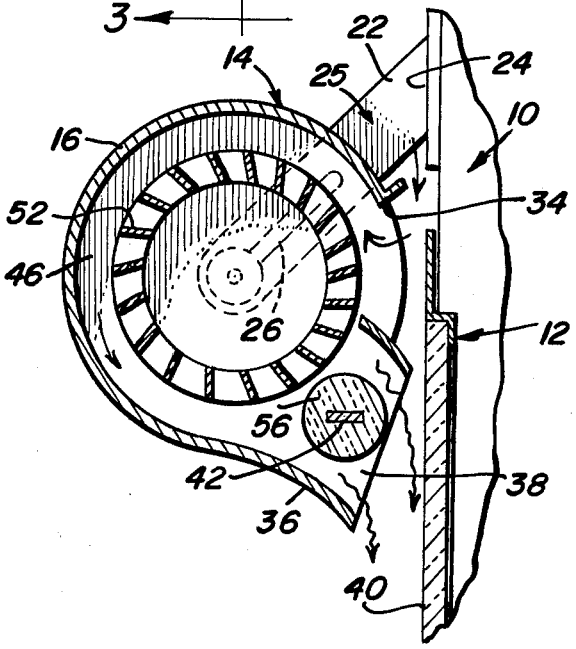
Fig. 3

BATHROOM MIRROR DEFOGGER

BACKGROUND OF THE INVENTION

Various forms of blower assemblies have been heretofore designed to receive or substantially eliminate the formation of condensation on a bathroom mirror. However, most of these prior known devices have been constructed in a manner whereby the appearance of the mirror area is adversely affected, the blower assembly is not operative to maintain substantially the full viewing face of the mirror free of condensation or the capacity of the blower assembly insofar as directing sufficient quantities of air over the associated mirror has not been sufficient.

Examples of previously patented bathroom mirror defogging assemblies are disclosed in U.S. Pat. Nos. 2,717,662, 3,200,705, and 3,384,977.

BRIEF DESCRIPTION OF THE INVENTION

The bathroom mirror defogger of the instant invention is constructed in a manner whereby heated air in curtain form may be directed downwardly across the viewing space of a bathroom mirror from the upper marginal edge portion of the mirror. A horizontally disposed elongated housing is provided for support immediately outward of the upper marginal edge portion of the associated mirror and the housing includes an internal blower assembly as well as inlet and outlet slots with the blower assembly being operable to intake air through the inlet slot and to exhaust air through the outlet slot in a downward direction along the associated mirror from the upper marginal edge portion thereof. The outlet slot is sufficiently wide to receive an elongated electrically operated resistance heating element therein for heating the air being discharged through the exhaust slot and in this manner the relative humidity of the air exhausted from the exhaust slot is reduced to assist in the prevention of formation of condenation on the viewing surface of the mirror and the evaporation of condensation from the viewing surface of the mirror in the event condensation has formed thereon prior to operation of the defogger.

The main object of this invention is to provide a defogging apparatus operable to cause a curtain of air to move rapidly across the viewing surface of a bathroom mirror.

Another object of this invention, in accordance with the immediately preceding object, is to provide heating means whereby the curtain of air directed across the viewing surface of the associated mirror will be heated prior to its movement across the mirror.

Yet another object of this invention is to provide a defogging apparatus in accordance with the preceding objects and which will have a pleasing appearance and not deter from the accepted appearance of conventional bathroom mirrors.

A final object of this invention to be specifically enumerated herein is to provide a defogging apparatus in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmentary perspective view of a bathroom wall portion having a bathroom mirror supported therefrom and the mirror defogging assembly mounted in operative association with the mirror;

FIG. 2 is an enlarged vertical sectional view taken substantially upon the place indicated by the section line 2—2 of FIG. 1; and FIG. 3 is a further enlarged fragmentary vertical sectional view taken substantially upon the plane indicated by the section line 3—3 of FIG. 2.

DETAILED DESCRIPTION OF THE INVENTION

Referring now more specifically to the drawings, the numeral 10 generally designates a wall structure from which a mirror assembly referred to in general by the reference numeral 12 is supported. The assembly 12 may be stationarily mounted from the wall structure 10, or it may be swingably supported therefrom as a portion of a wall mounted cabinet with the mirror assembly comprising a closure for the front of the cabinet.

The mirror defogger of the instant invention is referred to in general by the reference numeral 14 and includes a generally cylindrical horizontally elongated housing 16 having opposite end walls 18 and 20. A pair of mounting brackets 22 including base mounting flanges 24 and inclined housing mounting flanges 25 are provided and the base mounting flanges 24 are secured to the wall structure 10 in spaced relation above the opposite ends of the upper marginal edge portion of the mirror assembly 12 in any convenient manner. The housing mounting flanges 25 are downwardly and outwardly inclined and include outer end portions provided with longitudinal slots 26.

The end walls 18 and 20 include centrally outwardly projecting threaded studs 28 which are slidingly and rotatably received in the slots 26 and the end portions of the studs 28 projecting through the slots 26 have nulled nuts 30 threadedly engaged therewith. Accordingly, the longitudinally slotted free ends of the flanges 25 are clamped between the nuts 30 and the outer surfaces of the end walls 18 and 20. In this manner, the housing 16 is adjustably supported from the free end portions of the flanges 25 for adjustable shifting longitudinally of the slot 26 and angular displacement about the longitudinal center axis of the housing 16.

The wall portion of the housing 16 closely opposing the wall structure 10 as an inlet opening or slot 34 formed therein extending longitudinally of the housing 16 and the lower peripheral portion of the housing 6 is flared slightly as at 36 define an exhaust slot or outlet 38 which opens downwardly along the outer viewing side 40 of the mirror assembly 12.

An elongated electrical resistance-type heating element 42 is disposed within the exhaust slot or outlet 38 and the opposite end portions of the housing 16 include transverse partitions 44 and 46. The partitions 44 and 46 define the oppose end portions of the slots 34 and 38 and electric motor 48 is mounted within the housing 16 between the end wall 18 and the partition 44. The motor 48 includes a rotatable output shaft 50 rotatably received through the partition 44 and journaled between the latter and the partition 46. That portion of the shaft 50 extending between the partition 44 and 46 as a blower drum 52 mounted thereon which, upon counterclockwise rotation of the drum 52 as viewed in FIG. 3, causes ambient air to be drawn inwardly through the slot 34 and to move about the interior of the housing 16 in a counterclockwise direction to be thereafter discharged from the housing 16 through the slot 38 on both sides of the electrical resistance heating element 42.

That portion of the lower periphery of the housing 16 disposed between the partition 46 and the end wall 20 is provided with an on-off switch 54 and it is to be noted that the on-off switch 54 is to be serially connected in a loop circuit (not shown) electrically connected to a suitable source of household current, and with which a second loop circuit (not shown) is connected in parallel. The electric motor 48 is serially connected in the first loop circuit and the electrical resistance heating element 42 is serially connected in the second loop circuit, whereby actuation of the switch 54 to its on position will cause the motor 48 and the electrical resistance heating element 42 to be actuated, the heating element 42 being enclosed within a heat resistance and conductive dielectric body 56.

In operation, the discharge of heated air from the outlet 38 will cause a curtain of that heated air to float downwardly along the viewing surface 40 of the mirror assembly 12. Inasmuch as the housing 16 may be adjusted longitudinally of the flanges 25 and also angularly about its longitudinal center axis optimum positioning of the housing 16 and the inlet slot and outlet slot may be accomplished. Further, if the mirror assembly 12 is constructed to comprise a part of a cabinet door mounted for horizontal swinging, the bracket by which the housing 16 is supported may be mounted on the cabinet door for swinging with the latter. Alternately, the housing 16 may be stationarily mounted from the wall structure 10 at an elevation sufficient to enable the asociated mirror assembly 12 to swing under the housing 16 in the event the mirror assembly 12 comprises a part of a cabinet door.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with an upstanding mirror element supported from an upstanding interior wall and having a viewing surface disposed in an environment rendering said surface at least occasionally subject to the formation of condensation thereon and with said element including a generally horizontal upper marginal edge portion and upstanding opposite side marginal portions between which said upper marginal portion extends, a defogging apparatus comprising an elongated generally cylindrical horizontal housing extending along and supported outwardly of said upper marginal portion, the side of said housing adjacent said upper marginal portion and facing said wall including an upper elongated horizontal air inlet opening and a lower elongated horizontal air outlet opening with said openings extending longitudinally of said housing and opening toward the plane of said surface, said outlet opening being spaced from said inlet opening by a narrow portion of the peripheral wall of said housing and opening in a direction inclined toward the marginal portion of said mirror element remote from said upper marginal portion, motorized blower means including an elongated blower drum disposed within and housing and operative to draw ambient air into said housing through said inlet opening and to discharge air from said housing through said outlet opening, whereby a curtain of air will be directed upon said viewing surface and thereacross toward said remote marginal portion, a pair of bracket members secured to said wall adjacent and above the opposite ends of said upper marginal portion, said brackets extending outwardly from said wall and including outer portions provided with generally parallel elongated slots extending downwardly and outwardly away from said wall and said viewing surface, said housing extending between said brackets, the opposite end portions of said housing including endwise outwardly projecting threaded pivot pins generally coinciding with the longitudinal center axis of said housing and rotatably aad slidbly received in and through said slots, threaded clamp nuts threaded on the outer ends of said pins outwardly of said outer bracket portions releasably clampingly retaining said housing in adjusted rotated and slidingly shifted positions relative to said brackets, an elongated electrical resistance-type heating element disposed in and extending along said outlet opening between the opposite longitudinal sides thereof, said electrical resistance heating element being adapted to be communicated with a suitable source of electrical potential.

2. The combination of claim 1 wherein said elongated resistance-type heating element includes an outer covering of heat resistant and conductivedielectric material.

* * * * *